United States Patent [19]

Nesvizhsky

[11] Patent Number: 4,973,281

[45] Date of Patent: Nov. 27, 1990

[54] METHOD OF AND APPARATUS FOR PREAGEING ELECTRONIC VACUUM DEVICES

[75] Inventor: Jury B. Nesvizhsky, Leningrad, U.S.S.R.

[73] Assignee: Leningradsky Electrotekhnicksky Institute Svyazi, Leningrad, U.S.S.R.

[21] Appl. No.: 415,282

[22] PCT Filed: Dec. 28, 1987

[86] PCT No.: PCT/SU87/00160

§ 371 Date: Aug. 22, 1989

§ 102(e) Date: Aug. 22, 1989

[87] PCT Pub. No.: WO89/06435

PCT Pub. Date: Jul. 13, 1989

[51] Int. Cl.[5] ..... H01J 9/42

[52] U.S. Cl. ..... 445/6; 445/62

[58] Field of Search ..... 445/6, 62

[56] References Cited

FOREIGN PATENT DOCUMENTS

| | | | |
|---|---|---|---|
| 80636 | 5/1982 | Japan | 445/6 |
| 693469 | 10/1979 | U.S.S.R. . | |
| 983814 | 12/1982 | U.S.S.R. . | |
| 997130 | 2/1983 | U.S.S.R. . | |
| 1082903 | 9/1967 | United Kingdom . | |

OTHER PUBLICATIONS

Elektroizolyatsia i razryad v vakuume, 1972–I. N. Slivkov pp. 89–95.

*Primary Examiner*—Kenneth J. Ramsey

*Attorney, Agent, or Firm*—Lilling and Lilling

[57] ABSTRACT

A method of preageing vacuum devices comprises discharging, through the gap between the electrodes (14, 15) of a vacuum device (16) upon breakdown of said gap, an open long-line length (4) precharged to a voltage lower than the breakdown voltage and disconnected after breakdown in a time interval determined by the parameters of the long-time length (4).

An apparatus for preageing vacuum devices comprises terminals (1, 2) to connect a vacuum device (16) thereto, a breakdown voltage power supply (3) connected to the terminals (1, 2) also connected to which, through a diode (8), is an open long-line length (4) coupled with a charge voltage power supply (5). The long-line length (4) is discharged through the interelectrode gap of a vacuum device (16), upon breakdown of the gap, during a time interval equal to twice the time of propagation of an electromagnetic wave along the long-line length (4), after which the voltage across the latter changes its sign, causing a cuttoff state of the diode (8).

5 Claims, 1 Drawing Sheet

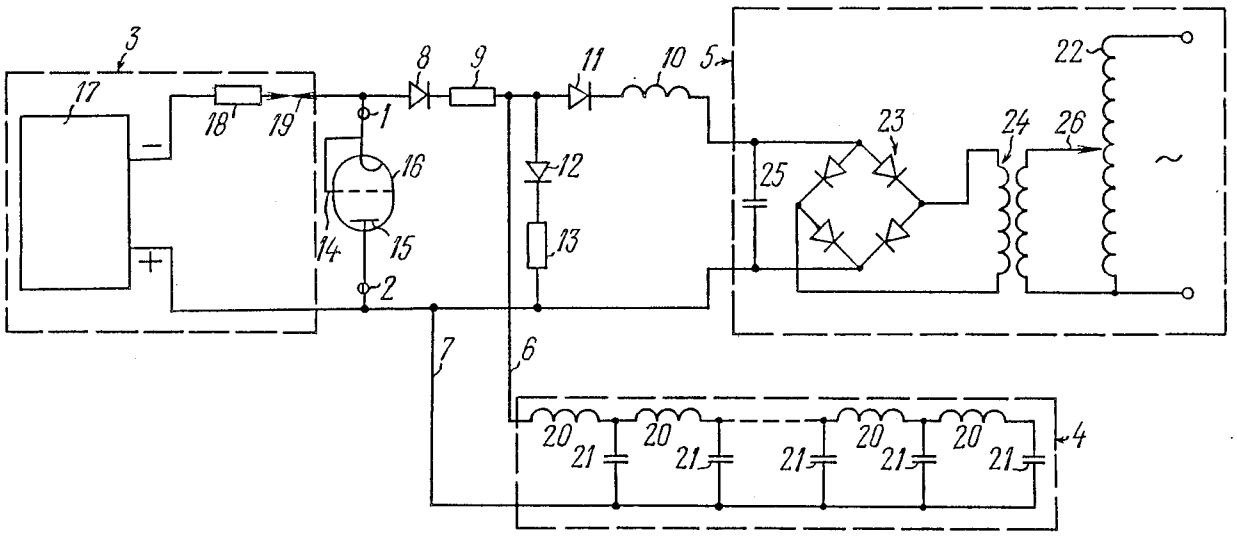
22
26
24
23
25
5
10
11
12
13
9
8
16
15
1
2
14
19
18
3
17
4
20
21
6
7

METHOD OF AND APPARATUS FOR PREAGEING ELECTRONIC VACUUM DEVICES

FIELD OF THE INVENTION

The invention relates to methods and apparatuses that allow improvement of the performance characteristics of electronic vacuum devices (called vacuum devices in what follows) by preageing them. Advantage may be taken of the invention to improve the dielectric strength and lifetime of vacuum devices as they are manufactured or used.

PRIOR ART

The process of preageing a vacuum device comprises applying to its electrodes voltage pulses sufficient to a breakdown of the gap between said electrodes and, as a result, arc inception between them, passing a current pulse through said gap upon arc inception, and repeating the above operations upon termination of said current pulse and, as a result, cessation of arcing between the electrodes of the vacuum device. The flow through the interelectrode gap of current pulses makes it possible to reduce microinhomogeneities (irregularities and contaminations) at the electrode surface, thus improving the dielectric strength and lifetime of the vacuum device.

Passing a current pulse through the interelectrode gap upon breakdown inception can be carried out by discharging a capacitor previously charged from a breakdown voltage power supply or a separate charge voltage power supply.

Known in the prior art is the method of preageing vacuum device that comprises application to the electrodes of a vacuum device to be aged of a voltage pulse whose height exceeds the breakdown voltage of the gap between said electrodes, which results in arc inception between them. Before arrival at the electrodes of said voltage, a capacitor is charged to a voltage which is higher than the voltage between the electrodes of the vacuum device upon arc inception but lower than said breakdown voltage. Then, upon arc inception between said electrodes, the capacitor is discharged through the gap between them and the above operations are repeated (SU, A, No. 997130). To avoid charging the capacitor to a voltage equal to or higher than the breakdown voltage, the capacitor is disconnected from said electrodes at the instant a voltage pulse having an amplitude higher than the breakdown voltage is applied to them and then the capacitor is connected again to them at the instant the arc strikes between them.

This method is carried into effect using a known apparatus comprising two terminals to connect the electrodes of a vacuum device to be aged thereto, a breakdown voltage power supply connected to said terminals, a capacitor whose one lead is connected with one of said terminals through a diode placed in a cutoff state with respect to the voltage fed from the breakdown power supply to this terminal while the other lead is connected to the other terminal, and a charge voltage power supply connected with the capacitor leads (SU, A, No. 997130). The breakdown voltage power supply applies to the terminals voltage pulses higher then the breakdown voltage of the gap between the electrodes and thus initiates arcing between them. As the capacitor is discharged, upon arc inception between the electrodes, a voltage is applied to them which has the same polarity as the voltage applied from the breakdown voltage power supply and causes the flow of a current pulse between the electrodes. The charge voltage power supply is connected to the capacitor leads so that the polarity of the charge voltage power supply's output terminal is identical with the polarity of that breakdown voltage power supply's output terminal which is connected with the terminal coupled to the capacitor lead which is connected with this output terminal of the charge voltage power supply. The charge voltage power supply serves to charge the capacitor to a voltage higher than the voltage between the electrodes upon arc inception therebetween (which is required to ensure the flow of a current pulse through the interelectrode gap upon breakdown) but lower than said breakdown voltage. The capacitor is charged from the charge voltage power supply in the time interval between the instant the interelectrode arcing ceases and the instant of a successive breakdown of the interelectrode gap through which the capacitor is discharged during arcing. A diode placed between the capacitor and one of the terminals ensures that the capacitor is disconnected from the electrodes of the vacuum device at the instant a pulse arrives at them from the breakdown voltage power supply till the termination of this pulse and thus prevents the capacitor from being charged to a voltage equal to or higher than the breakdown voltage.

To maintain optimum preageing conditions, the voltage to which the capacitor is charged before a breakdown-provoking pulse is applied may be varied in the preageing process. To this end, the charge voltage power supply may be provided with appropriate facilities for varying its output voltage. Varying the capacitor charge voltage makes it possible to adjust the initial discharge current passing through the interelectrode gap by varying the voltage of said power supply and thus set up the intensity of the processes of fusing and evaporating microinhomogeneities on the electrodes according to changes in the state of a vacuum device being aged.

At the same time, as the capacitor is discharged, the current through the interelectrode gap falls off exponentially and its initial value chosen usually from the condition that current pulses pass through the interelectrode gap which have a required power, may become too large, resulting in new irregularities at the electrode surface and, accordingly, a decrease in the dielectric strength of the vacuum device. Besides, the passage of a current through the interelectrode gap stops at the instant this current becomes smaller than the interelectrode gap arc quench current whose value is dependent on the state of electrode surfaces and thus is liable to changes. This leads to a change in the duration of current pulses flowing through the interelectrode gap in the preageing process and hence does not allow maintaining at a certain constant level the power of pulses applied to the vacuum device, which is important to ensure required preageing conditions. Nor does said change in the pulse duration allow the use of small-slope pulses with a low initial discharge current for obtaining a required power since, in this case, the change in the pulse power and duration will be too large because of a slow current decline.

Moreover, in using a capacitor discharge, it is difficult to adjust independently the magnitude and duration of an interelectrode gap discharge current pulse since a change in any of the three parameters, viz., the capacitance of the capacitor, its discharge circuit impedance or the voltage of the charge voltage power supply, results in a simultaneous change in both the magnitude and duration of a current pulse.

Also known in the prior art is the method of preageing vacuum device in which, in place of a storage capacitor, an open length of a long line is used (SU, A, No. 983814). This method comprises application to the electrodes of a vacuum device to be aged of a voltage pulse whose magnitude exceeds the breakdown voltage of the gap between said electrodes, which results in arcing between them. Before arrival at the electrodes of said voltage, the open long-line length is charged to a voltage equal to said breakdown voltage. Then, upon arc inception between said electrodes, the long-line length connected to said electrodes of the vacuum device is discharged through the gap between them, and the above operations are repeated.

This preageing method is carried out by means of a known apparatus for preageing vacuum devices which comprises two terminals to connect the electrodes of a vacuum device to be aged thereto, a breakdown voltage power supply connected to said terminals to apply to them voltage pulses higher than the breakdown voltage between said electrodes of the vacuum device, causing arcing between them, and an open long-line length, the leads of one of the ends of which are connected properly to said terminals. Between the leads of the long-line length, a series circuit may be connected which is comprised of a diode placed in a cutoff state with respect to the voltage fed from the charge voltage power supply, and a low-value resistor (SU, A, No. 983814).

The long-line length may be constituted by a length of a coaxial cable or its equivalent lumped-parameter circuit containing inductors connected to form a series network whose end constitutes one of the circuit leads, and capacitors, the inductors being respectively coupled to the other circuit lead via said capacitors. In this apparatus, the long-line length is charged directly from the breakdown voltage power supply. Charging the long-line length stops at the instant the interelectrode gap breaks down, i.e., said length is charged to the breakdown voltage. Upon arc inception between the electrodes, the long-line length is discharged through the interelectrode gap, thus applying to it a voltage having the same polarity as the voltage applied from the breakdown voltage power supply and exceeding in value the voltage between the electrodes upon the arc strikes across them.

The long-line length must have a wave impedance equal to or higher than the discharge circuit impedance. If the wave impedance of the long-line length is lower than the discharge circuit impedance, the discharge current falls off in steps. Such a falling-off current form will prevent pulses having a certain constant power from being applied to the vacuum device and restrict the capability to reduce the initial discharge current, which is also the case for a storage capacitor. If the wave impedance of the long-line length is equal to the discharge circuit impedance, the current in this circuit has the form of a single-polarity rectangular pulse. The duration of this pulse is twice the time of propagation of an electromagnetic wave along the long-line length, i.e., is determined by the parameters of said length and is independent of the interelectrode arc quench current, which allows the passage through the interelectrode gap of current pulses having a constant power. On the other hand, in contrast to a falling-off current form, the unchangeability of the current in the discharge process allows lowering the maximum value which should be attained by the current in the discharge process to ensure a required current pulse power, thus avoiding possible deterioration of the parameters of a vacuum device as a result of the passage through it of too large current. If the wave impedance of the long-line length is higher than the discharge circuit impedance, the discharge current has the form of a train of different-polarity rectangular pulses with decreasing pulse amplitude. The duration of each pulse of said train is determined in the same manner as in using a long-line length with a wave impedance equal to the discharge circuit impedance, which enables one to use the first pulse of the discharge current as a constant-power rectangular current pulse fed to the vacuum device during interelectrode arcing if the arcing is quenched at the beginning of a second discharge-current pulse having a polarity opposite to that of the first pulse, i.e., upon polarity reversal of the voltage between the leads of the long-line length in the process of its discharge.

The use of a long-line length also makes it possible to adjust independently the discharge current (by varying the resistor value in the discharge circuit) and its duration (by varying the electric length value of the long-line length, i.e., the cable length or the number of inductive and capacitive sections).

In the process of preageing many types of high-power high-voltage vacuum devices, the voltage applied to a vacuum device from a breakdown voltage power supply may be very high (up to 100 kV or higher). In the case of charging a long-line length to the breakdown voltage (to the voltage of the breakdown voltage power supply), in accordance with the above method and apparatus, to avoid the flow of too large current (e.g., in excess of several tens of amperes) through the interelectrode gap during arcing, the discharge circuit impedance and hence the wave impedance of the long-line length (which should not be lower than the discharge circuit impedance) should be sufficiently high (e.g., several kiloohms). At the same time, to obtain a high wave impedance, the inductive components which make up the line must have a high inductance, and the capacitive components, a low capacitance. Therefore, it is very difficult to build up a long-line length with a high wave impedance even by using a lumped-parameter circuit, to say nothing of a cable. The use of low-value capacitors results in an enhancement of the effect of spurious capacitances which, in addition to that, increase, when using large inductance coils, because of an increase in turn-to-turn capacitances. Moreover, it is very difficult to ensure electrical insulation of large inductance coils designed for high voltages.

These factors create complications in the design of a long-line length and set limits on a possible reduction in the arc current flowing through the interelectrode gap when preageing vacuum devices with a high breakdown voltage.

The wave impedance of a long-line length is usually chosen to be in excess of the discharge circuit impedance so as to allow varying the latter in the preageing process to adjust the current with the purpose of maintaining optimum preageing conditions. However, in so choosing the wave impedance, the discharge current, as stated above, consists in a train of different-sign rectangular pulses and the danger develops that the arcing will not cease at the end of the first pulse of the train and will continue or repeat upon reversal of the polarity of the voltage between the leads of the long-line length in the process of its discharge. Such a continuation or repetition of arcing may occur as a result of the flow of subsequent pulses of said train through the interelectrode gap in which deionization has not had time to come about, which will lead to a disturbance in the preageing conditions. The probability that such an arcing continuation or repetition occurs prior to a consecutive breakdown of the interelectrode gap depends on the properties of the interelectrode gap of a vacuum device such as the breakdown voltage, arc quench current, the time required to deionization of the interelectrode gap upon arc quenching, etc. Although it is possible to lower drastically the magnitude of the second pulse by placing a diode in a cutoff state and a low-value resistor in parallel with the leads of the long-line length, the height of the third pulse, herewith, decreases only slightly. It is possible to attain a drastic reduction in the third pulse value by placing in series with said diode a resistor having a resistance close to the wave impedance of the long-line length since, in this case, the discharge will practically stop at the second pulse. However, in so doing, we shall not ensure an effective reduction of the second pulse. These factors set limits on the choice of possible amplitudes and durations of the discharge current pulse flowing through the interelectrode gap in the preageing process and thus restrict the capability to improve the parameters of vacuum devices by preageing.

DISCLOSURE OF THE INVENTION

The principal object of the present invention is to provide a method of and an apparatus for preageing vacuum devices wherein a long-line length discharged through the interelectrode gap of a vacuum device should be charged and discharged so as to prevent arcing between the electrodes upon reversal of polarity of the voltage between the leads of the long-line length in the process of its discharge and to provide the possibility of using a long-line length with a lower wave impedance and thus enhance the potentialities offered by preageing for improving the performance characteristics of the vacuum device and simplify the design of the long-line length.

With this principal object in view, there is proposed a method of preageing vacuum devices which comprises the steps of charging a long-line length, applying to the electrodes of a vacuum device to be preaged a voltage pulse whose value exceeds the breakdown voltage of the gap between said electrodes whereby an arc strikes between them, discharging the open long-line length connected to said electrodes of the vacuum device upon arc striking and repeating said operations, the long-line length being charged to a voltage higher than the voltage between said electrodes upon arc striking, wherein, according to the invention, the long-line length is disconnected from the electrodes of the vacuum device in a time interval after arc striking which is twice the time of propagation of an electromagnetic wave along the open long-line length, said length is charged to a voltage which is lower than said breakdown voltage, and said length is connected to the electrodes of the vacuum device at the arc striking instant.

With this principal object in view, there is also proposed an apparatus for preageing vacuum devices which comprises two terminals to connect the electrodes of a vacuum device to be aged thereto, a breakdown voltage power supply connected to said terminals for applying to them voltage pulses higher than the breakdown voltage of the gap between said electrodes of the vacuum device and causing arc striking between them, and an open long-line length whose leads of one of its ends are respectively connected to said terminals for applying to them, in the process of discharging the long-line length upon arc striking between the electrodes of the vacuum device a voltage having the same polarity as the voltage applied from the breakdown voltage power supply and causing the flow through the interelectrode gap of a rectangular current pulse, in which, according to the invention, there is further provided a charge voltage power supply which is connected to said leads of the long-line length and in which the polarity of the output terminal connected to the lead of the long-line length is identical with the polarity of that breakdown voltage power supply terminal which is connected to the terminal coupled with this lead of the long-line length for charging the long-line length to a voltage which exceeds the voltage between said electrodes of the vacuum device upon arc striking but is lower than said breakdown voltage, and a diode placed between one of said terminals and the long-line length lead connected to it in a cutoff state with respect to the voltage applied to this terminal from the breakdown voltage power supply.

The diode placed between the terminal to which the vacuum device is connected and the lead of the long-line length when turned off ensures disconnection of said length from the electrodes of the vacuum device at the instant the first pulse of a train of long-line length discharge current pulses of different polarity terminates and the second one starts, and thus prevents interelectrode arc from burning when polarity of the voltage between the leads of the long-line length is changed. This allows to select the amplitude and duration of an interelectrode discharge current pulse in a wider range, which, in turn, enhances the potentialities of improvement of the characteristics of vacuum devices by preageing.

Charging the long-line length to a voltage lower than the breakdown voltage allows a reduction in the current flowing between the electrodes of the vacuum device in the process of arcing without an increase in the wave impedance of the long-line length. This, in turn, makes it possible to use, for preageing vacuum devices having a large breakdown voltage, a long-line length having a relatively low wave impedance and hence a simpler design.

It is expedient, in the preageing process, to vary the voltage to which the long-line length is charged with the purpose of adjusting the current flowing through the interelectrode gap during arcing in accordance with parameter variations in a vacuum device being aged. To this end, the charge voltage power supply may be provided with output voltage adjustment facilities. Adjustment of the discharge current by varying the charge voltage of the long-line length allows not only controlling said current, irrespective of the discharge current pulse duration, but also expanding the adjustment range of said current as compared to controlling said current by varying the discharge circuit impedance whose maximum value is limited by the wave impedance of the long-line length.

To ensure charging the long-line length to a voltage exceeding considerably the voltage of the charge voltage power supply, it is expedient to carry out charging through a series circuit comprising an inductor and a diode placed in a conduction state with respect to the voltage applied from the charge voltage power supply. If, however, the discharge circuit impedance for the second pulse of the different-polarity pulse train of the long-line length discharge current is determined by the large reverse resistance of a cutoff diode placed between the terminal to which the vacuum device is connected and the lead of the long-line length, then charging the latter through the inductor and diode will result in a gradual increase in the voltage across the long-line length, i.e., a deviation of the voltage from its optimum value. To avoid such an increase in the voltage across the long-line length, a series circuit comprising a resistor and a diode placed in a conduction state with respect to the voltage applied from the charge voltage power supply to the leads of the long-line length may be connected between said leads. In this case, it is possible to carry out a practically total discharge of the long-line length during the second current pulse through said circuit connected to its leads and thus to prevent the voltage across the long-line length from increasing from charging to charging as well as to reduce practically to zero the third voltage pulse which, because of its considerable value could create the danger of repeated arc striking between the electrodes of the vacuum device. To this end, the resistor in said circuit must have a resistance close to the wave impedance of the long-line length.

The invention will be further described in detail, by way of examples of carrying it into effect, with reference to the accompanying drawing.

SUMMARY OF THE DRAWING

The drawing is the circuit diagram of an apparatus for preageing vacuum devices made in accordance with the present invention and implements the method of preageing vacuum devices, accomplished in accordance with the invention.

BEST MODE OF CARRYING THE INVENTION INTO EFFECT

According to the drawing, the apparatus for preageing vacuum devices comprises terminals 1 and 2 to connect a vacuum device thereto, a breakdown voltage power supply 3, an open long-line length 4 and a charge voltage power supply 5. The negative and positive terminals of the breakdown voltage power supply 3 are connected to the terminals 1 and 2, respectively. The lead 6 of one of the ends of the long-line length 4 is connected with the terminal 1 through a diode 8 whose anode is connected to the terminal 1, and a resistor 9 through which the cathode of the diode 8 is connected with the lead 6 of the long-line length 4. The other lead 7 of the same end of the long-line length 4 is connected with the terminal 2. The negative and positive terminals of the charge voltage power supply 5 are connected with the leads 6 and 7 of the long-line length 4, respectively, through an inductor 10 and a diode 11 placed in series between the negative terminal of the power supply 5 and the lead 6 of the long-line length 4. Connected between the leads 6 and 7 of the long-line length 4 is a series circuit including a diode 12 whose anode is connected with the lead 6 of the long-line length 4 and a resistor 13 through which the cathode of the diode 12 is connected with the lead 7 of the long-line length 4.

Also connected to the terminals 1 and 2 are the electrodes 14 and 15 of a vacuum device 16, e.g., a high-power oscillator valve.

The breakdown voltage power supply 3 is of a known design and comprises a high-voltage power supply 17, a ballast resistor 18 and a spark gap 19 whose one electrode is connected through the resistor 18 with the negative terminal of the power supply 17. The negative and positive terminals of the breakdown voltage power supply 3 are constituted by a wire connected with the other electrode of the spark gap 19 and by the positive terminal of the power supply 17, respectively.

The open long-line length 4 is built as a lumped-parameter circuit comprising inductors 20 connected to form a series circuit whose end constitutes the lead 6 of the long-line length 4 and capacitors 21 via which the inductors 20 are respectively connected with the wire which constitutes the other lead 7 of the long-line length 4. A distributed-parameter device may also be used as the open long-line length 4 such as a coaxial cable length, the leads of one of its ends constitute the leads connected similarly to the leads 6 and 7 in the circuit represented in the drawing, and whose other end is open.

The charge voltage power supply 5 is a d.c. voltage power supply and comprises an auto-transformer 22 whose primary winding is connected to the a.c. mains, a rectifier 23 whose input terminals are connected to the secondary winding of the auto-transformer 22 through an isolating transformer 24 and whose output terminals constitute the output terminals of the power supply 5. A filter capacitor 25 is placed at the output of the rectifier 22. The power supply 5 is provided with facilities for adjusting its output voltage that have the form of a movable contact 26, through which one of the leads of the primary winding of the isolating transformer 24 is connected with the secondary winding of the auto-transformer 22.

The apparatus operates as follows.

The long-line length 4 is charged from the power supply 5 through the inductor 10 and diode 11. The inductance of the inductor 10 considerably exceeds the total inductance of the inductors 20 of the long-line length 4. In this case, the latter is charged similarly to charging a capacitor. It is known that charging a capacitor through an inductor results in an oscillatory process, in the course of which the voltage across the capacitor attains a value close to twice the input voltage. At the instant the voltage across the long-line length 4 attains a maximum value close to twice the voltage of the power supply 5, the diode 11 turns off, ensuring that the long-line length 4 is charged to twice said voltage. Thus, placing in the charge circuit of the long-line length 4 the inductor 10 and diode 11 makes it possible to reduce by one half the voltage of the charge voltage power supply 5. To avoid a breakdown of the vacuum device 16 when charging the long-line length 4, the voltage of the power supply 5 is chosen so as to ensure charging the long-line length 4 to a voltage considerably lower than the breakdown voltage.

Since the diode 12 is placed in the cutoff state with respect to the voltage of the power supply 5, the value of the resistor 13 does not affect charging the long-line length 4 from the power supply 5.

The voltage of the power supply 17 is applied to the terminals 1 and 2 upon breakdown of the spark gap 19. The breakdown of the spark gap 19 may be effected by bringing closer together its electrodes, ionizing its interelectrode gap with the help of an auxiliary source or increasing the voltage of the power supply 17 to a required value. The voltage of the power supply 17 which arrives through the terminals 1 and 2 at the electrodes 14 and 15 of the vacuum device 16 exceeds the breakdown voltage of the interelectrode gap and thus causes a breakdown of said gap and arcing between the electrodes 14 and 15. Thereupon, the voltage between the electrodes 14 and 15 sharply decreases, say from several tens of kilovolts to several tens of volts. The high voltage from the power supply 3 is kept from arrival at the long-line length 4 by the diode 8 placed in a cutoff state with respect to the power supply 3.

The ballast resistor 18 limits the output current of the power supply 3 to a level considerably lower than the arc quench current so that the power supply 3 cannot maintain arcing between the electrodes 14 and 15. Nevertheless, the arcing continues as a result of connecting to the electrodes 14 and 15 through the diode 8, which, at the instant the voltage across the interelectrode gap drops because of arc inception, is found in a conduction state, the long-line length 4 which discharges through the diode 8, resistor 9 and interelectrode gap 14–15. To this end, the voltage of the power supply 5 is chosen so as to ensure charging the long-line length 4 to a voltage exceeding the voltage between the electrodes 14 and 15 upon arc inception between them and sufficiently high to maintain a current through these electrodes which exceeds the arc quench current. On the other hand, the value of the inductor 10 is chosen so that the time of charging the long-line length 4 is far in excess of the discharge time and, therefore, the power supply 5 does not affect the discharge of the long-line length 4 through the interelectrode gap 14–15.

Concurrently with discharge inception, in the long-line length 4, a discharge electromagnetic wave is brought about which travels from the leads 6 and 7 to its open end, the wave current being equal to the current through the vacuum device 16. Herewith, the discharge wave voltage is subtracted from the voltage to which the long-line length 4 was precharged. Upon reaching the open end, the discharge wave is completely reflected. This reflection occurs without any change in the value but with a change of the current sign. As a result, a reverse electromagnetic discharge wave arises which travels from the open end of the long-line length 4 to the leads 6 and 7.

The wave impedance of the long-line length 4 is chosen higher than or equal to the discharge circuit impedance, i.e., the sum of the impedances of the arc between the electrodes 14 and 15. And the circuit comprised of the diode 12 and the resistor 13 does not affect the discharge of the long-line length 4 since the diode 12 is found to be in the cutoff state with respect to the voltage between the leads 6 and 7.

If the wave impedance of the long-line length 4 exceeds the discharge circuit impedance, which is usually the case, then the discharge wave voltage exceeds half the voltage to which the long-line length 4 was charged. Therefore, once the reflected wave has reached the leads 6 and 7, the voltage across them reverses its sign, the diode 8 turns off to disconnected the long-line length 4 from the electrodes 14 and 15 and stop the passage of current through these electrodes with the result that the arc between them is quenched.

If there were no circuit comprised of the diode 12 and resistor 13, once the voltage across the leads 6 and 7 has changed its sign, the impedance of the discharge circuit of the long-line length 4 would have been determined by the high reverse impedance of the diode 8 with the result that charging the long-line length 4 from the power supply 5 would have been initiated not with zero voltage across the leads 6 and 7 but with a voltage of opposite sign with respect to the voltage fed from the power supply 5. With the presence of the inductor 10 and diode 11, this would have resulted in a corresponding increase in the voltage to which the long-line length 4 has been charged, since, as stated above, the peak of the voltage across the capacitor charged through an inductance coil is close to twice the input voltage which, in this case, would have been equal to the sum of the voltage of the power supply 5 and the voltage of opposite sign which existed across the long-line length 4 at the beginning of the charging process. An increase in the voltage across the long-line length 4 upon charging would, in turn, have resulted in an increase in the voltage of opposite sign remaining across the long-line length 4 by the beginning of the charging of the long-line length 4. Such a gradual increase in the voltage across the length 4 would have resulted in its deviation from a required optimum value.

With the circuit comprised of the diode 12 and resistor 13, the second pulse of the discharge current, which pulse is brought about, once the voltage across the leads 6 and 7 has changed its sign, will pass through the diode 12 found to be in a conduction state and the resistor 13. During the second current pulse, in the long-line length 4, a discharge wave arises again travelling from the leads 6 and 7 to the open end of the long-line length 4 and back. The value of the resistor 13 is close to the wave impedance of the long-line length 4, which ensures a total or almost total discharge of the long-line length 4 during the second current pulse and thus practically zero voltage across the long-line length 4 at the end of said second pulse and hence at the beginning of the charging of said length from the power supply 5.

The charge voltage power supply 5 may obviously be connected with the long-line length 4 in a different manner, e.g., in place of the inductor 10 and diode 11, a resistor may be connected between the power supply 5 and the long-line length 4 with a value ensuring that the time constant of charging the long-line length 4 is far in excess of the discharge time constant, or, instead, a switch which closes upon quenching of the arc between the electrodes 14 and 15 and opens upon breakdown of the gap between said electrodes. In such cases, the voltage across the long-line length 4 in the end of charging will not depend on the voltage across said length at the beginning of charging so that the circuit comprised of the diode 12 and resistor 13 need not be used.

Upon completion of the discharge of the long-line length 4 and the quenching of the arc between the electrodes 14 and 15, charging the long-line length 4 from the power supply 5 resumes. Upon completion of charging the long-line length 4, the following takes place: again a breakdown of the spark gap 18 and of the gap between the electrodes 14 and 15, arc inception between them, connection to the electrodes 14 and 15 through the diode 8 of the long-line length 4 and its discharge, as described above. These operations resume till the end of the preageing process, i.e., till the required dielectric strength of the vacuum device 16 is achieved.

When using inductor 10, diodes 11 and 12, and resistor 13, or charging the long-line length 4 through a resistor or switch, in both cases the diode 8 turning off and disconnecting the long-line length 4 from the electrodes 14 and 15 of the vacuum device 16 after a time interval following the arc inception equal to twice the time of propagation of an electromagnetic wave along the long-line length 4 eliminates the danger of arc inception under the action of the second or any other of the subsequent pulses of the train of different-sign pulses of the discharge current of the long-line length 4 with a wave impedance higher than the discharge circuit impedance. This allows a choice in a wide range of pulse heights and durations of the current passing through the vacuum device 16 during arcing between the electrodes 14 and 15 without disturbing the required preageing conditions since the discharge current pulse duration (provided, of course, that the discharge current pulse ceases before the instant the arcing between the electrodes of the vacuum device ceases spontaneously) will always be equal to twice the time of propagation of an electromagnetic wave along the long-line length 4. Said propagation time depends not only on the electric length of the long-line length 4, i.e., on the number of inductive and capacitive sections 20, 21 in the case of using a lumped-parameter long line or on the physical length of the coaxial cable length. The capability of choosing in a wide range of discharge current pulse heights and durations enhances the potentialities of improving the parameters of the vacuum device by preageing.

While being discharged, an open long-line length behaves, with respect to the vacuum device 16, as a d.c. generator with an electro-motive force equal to the voltage to which the long-line length 4 was precharged and an internal resistance equal to the wave impedance of the long-line length. Therefore, through the electrodes 14 and 15 during arcing, a practically constant current flows whose value is determined by the initial voltage across the long-line length 4, its wave impedance and the discharge circuit impedance. Thus, in the process of discharge of the long-line length 4, through the electrodes 14 and 15 a rectangular current pulse flows whose height and duration are determined by the circuit parameters as indicated above.

It is particularly convenient to adjust the discharged current by varying the voltage at the input of the charge voltage power supply 5 since a variation of the discharge circuit impedance, e.g., that of the resistor 9, is limited by the wave impedance of the long-line length 4. The output voltage of the power supply 5 is varied by sliding the movable contact 26.

Since the initial voltage across the long-line length 4 is determined by the voltage of the power supply 5, the current through the electrodes 14 and 15 in the process of arcing depends on the voltage of the power supply 5 and does not depend on the breakdown voltage. This guards against the danger that too large a current flows through the electrodes 14 and 15 and impairs the dielectric strength of the vacuum device 16, if a relatively low impedance (e.g., a low-value resistor 9) of the discharge circuit of the long-line length 4 is used. To this end, an accordingly small voltage of the power supply 5 is chosen, even if the breakdown voltage of the vacuum device 16 (and hence the voltage delivered by the power supply 3) is very high. This, in turn, allows the use, in the case of a very high breakdown voltage, of a long-line length 4 having a relatively low wave impedance (which, as indicated above, must not be lower than the discharge circuit impedance) and hence a simplification in the design of a long-line length made in the form of a lumped-parameter circuit or even the use of a mere coaxial cable length, instead.

INDUSTRIAL APPLICABILITY

The invention may be used for preageing vacuum devices in their manufacturing process for cleaning of impurities from their electrodes and reducing irregularities at the electrode surfaces, thus improving the dielectric strength and lifetime of vacuum devices. This kind of preageing may be carried out, e.g., in the process of evacuating a device or upon completion of its manufacture. The invention may also be used for ageing vacuum devices while they are in use with the purpose of eliminating impurities and irregularities which arise at the surface of the electrodes of vacuum devices in transit, storage or use. The invention may be used most advantageously for preageing high-power vacuum devices, including triodes, tetrodes, klystrons, travelling wave valves and other types of vacuum devices employed in high-power radio transmitters or radio-frequency industrial heaters.

I claim:

1. A method of preageing vacuum devices which comprises the steps of charging a long-line length (4), applying to the electrodes (14, 15) of a vacuum device (16) to be preaged a voltage pulse whose value exceeds the breakdown voltage of the gap between said electrodes (14, 15) whereby an arc strikes between them, discharging the open long-line length (4) connected to said electrodes (14, 15) of the vacuum device (16) through the gap between them upon arc striking and repeating said operations, the long-line length (4) being charged to a voltage higher then the voltage between said electrodes (14, 15) upon arc striking, characterized in that after arc striking in a time interval equal to twice the time of propagation of an electromagnetic wave along the open long-line length (4) the latter is disconnected from the electrodes of the vacuum device, charged to a voltage lower than said breakdown voltage and connected to the electrodes (14, 15) of the vacuum device (16) at the instant of arc striking.

2. A method as claimed in claim 1 characterized in that the voltage to which the long-line length (4) is charged is varied in the preageing process.

3. An apparatus for preageing vacuum devices which comprises two terminals (1, 2) to connect the electrodes (14, 15) of a vacuum device (16) to be preaged thereto, a breakdown voltage power supply (3) connected to said terminals (1, 2) for applying to them pulses of a voltage higher than the breakdown voltage of the gap between said electrodes (14, 15) of a vacuum device (16) and striking an arc between them, and an open long-line length (4) whose leads (6, 7) of one of its ends are respectively connected to said terminals (1, 2) for applying to them, in the process of discharging the long-line length (4) upon arc striking between the electrodes (14, 15) of the vacuum device (16), a voltage having the same polarity as the voltage fed from the breakdown voltage power supply (3) and causing the flow through the gap between said electrodes (14, 15) of a rectangular current pulse characterized in that it further comprises a charge voltage power supply (5) which is connected to said terminals (6, 7) of the long-line length (4) and in which the polarity of the output terminal connected to the lead (6, 7) of the long-line length (4) is the same as the polarity of that breakdown power supply output terminal which is connected with the terminal (1, 2) coupled with this lead (6, 7) of the long-line length (4)

for charging the long-line length (4) to a voltage higher than the voltage between said electrodes (14, 15) of the vacuum device (16) upon arc striking, but lower than said breakdown voltage, and a diode (8) placed between one of said terminals (1) and the lead (6) of the long-line length (4), connected thereto in a cutoff state with respect to the voltage applied to this terminal (1) from the breakdown voltage power supply (3).

4. An apparatus as claimed in claim 3, characterized in that the charge voltage power supply (5) is provided with facilities (26) for adjusting the output voltage.

5. An apparatus as claimed in claim 3 characterized in that the charge voltage power supply (5) is connected to the leads (6, 7) of the long-line length (4) via a series network comprising of an inductor (10) and a diode (11) placed in a conduction state with respect to the voltage applied from the charge voltage power supply (5) to to the leads (6, 7) of the long-line length (4), a series network comprising a resistor (13) and a diode (12) placed in a cutoff state with respect to the voltage applied from the charge voltage power supply to the leads (6, 7) of the long-line length (4) being connected therebetween.

* * * * *